United States Patent [19]

Kohnke

[11] Patent Number: 4,715,141

[45] Date of Patent: Dec. 29, 1987

[54] SPENT CARTRIDGE COLLECTOR

[76] Inventor: William M. Kohnke, 1170 Garraty Rd., San Antonio, Tex. 78209

[21] Appl. No.: 919,600

[22] Filed: Oct. 17, 1986

Related U.S. Application Data

[63] Continuation of Ser. No. 816,653, Jan. 6, 1986, abandoned.

[51] Int. Cl.[4] ..... F41C 27/00

[52] U.S. Cl. ..... 42/98

[58] Field of Search ..... 42/98; 89/33.4

[56] References Cited

U.S. PATENT DOCUMENTS

| | | | |
|---|---|---|---|
| 1,201,189 | 10/1916 | Johnson | 42/1 T |
| 1,304,468 | 5/1919 | Fernandez | 42/1 T |
| 3,153,981 | 10/1964 | Brass | 89/33.4 |
| 3,739,685 | 6/1973 | Lundgren | 89/33.4 |
| 3,771,248 | 11/1973 | Linehan | 42/1 T |
| 4,028,834 | 6/1977 | Dobson | 42/1 T |
| 4,110,927 | 9/1978 | Morris | 42/1 T |
| 4,334,375 | 6/1982 | Olson | 42/1 T |

FOREIGN PATENT DOCUMENTS

| | | | |
|---|---|---|---|
| 2424719 | 1/1975 | Fed. Rep. of Germany | 42/1 T |

*Primary Examiner*—Stephen C. Bentley
*Assistant Examiner*—Stephen M. Johnson
*Attorney, Agent, or Firm*—Richard J. Donahue; Donald J. Singer

[57] ABSTRACT

A spent cartridge collector for use with a firearm with a side opening cartridge ejection port. The collector is hinged to permit quick access to and inspection of the firearm ejection port and includes a cartridge collection bag having Velcro strips at the bottom thereof for facilitating the emptying of the bag.

1 Claim, 9 Drawing Figures

SPENT CARTRIDGE COLLECTOR

STATEMENT OF GOVERNMENT INTEREST

The invention described herein may be manufactured and used by or for the Government for governmental purposes without the payment of any royalty thereon.

This application is a continuation of application Ser. No. 816,653 filed Jan. 6, 1986, now abandoned.

BACKGROUND OF THE INVENTION

The present invention concerns apparatus for collecting cartridge casings and more particularly concerns a device for collecting casings from spent shells or cartridges as they are ejected from a firearm, such as an M-16 rifle.

During firearm practice and particularly during the tactical training period of military personnel, one of the more important training exercises is that of shooting at targets. In order to develop and maintain proficiency in firearm use, such target practice is normally undertaken on a repetitive basis with a resulting large expenditure in the number of cartridges used.

Spent cartridges ejected from a firearm are usually free to drop onto the ground to be collected later, or abandoned. Since one of the major costs in a cartridge is the cost of the brass cartridge casing itself, and since such spent casings are quite often abandoned, the cost of target practice has become increasingly more expensive. Although to police for such empty casings is time consuming, to abandon them creates the potential danger of injury to military personnel tripping over the casings, and damage to vehicle tires from lost casings which become embedded in roadways. In the absence of any device for catching spent cartridges as they are ejected from a firearm, they are able to strike and injure nearby marksmen, thus presenting an additional personnel hazzard.

Although a number of cartridge catching devices have been developed in the past, they suffer from one or more deficiencies which limit their effectiveness. Many, for example, are not affixed to the firearm in a manner to permit the shooter to "hit the dirt" during training exercises without fear of damaging the device upon contact with the ground. Others are shaped such as to enable the ejected shells to rebound towards the ejection chamber and jam in it, especially in the case of the longer cartridges used with blank ammunition. None are constructed to permit an easy and safe visual inspection of the ejection port of the firearm without removal of the device from the firearm. Many do not fully enclose the firearm ejection port while others do not provide means to periodically empty the cartridge collection bag without removal of the entire device from the firearm. Other prior art devices obstruct the proper operation of the firearm by a left-handed marksman.

SUMMARY OF THE INVENTION

Accordingly, it is the general purpose and object of the present invention to provide a spent cartridge collector which can be conveniently, safely and securely mounted onto a firearm, and includes a rugged container for collecting the spent cartridges.

Another object of the invention is to provide a spent cartridge collector which can be adapted for use with various firearms and which includes a collection receptacle which can be periodically emptied without detaching the collector from the firearm.

A further object of the invention is to provide a spent cartridge collector which permits inspection of the firearm ejection port without detaching the collector from the firearm.

A further object of the invention is to provide a spent cartridge collector which is easy to produce, requires few parts and is therefore simple and reliable in use.

A further object of the invention is to provide a spent cartridge collector which is durable, and which conforms to firearm safety requirements.

A further object of the present invention is to provide a spent cartridge collector having internal clearances which minimize jamming of the firearm ejection port by a rebounding spent cartridge.

A further object of the present invention is to provide a spent cartridge collector which is usable on firearms operated by left-handed marksmen.

Briefly, these and other objects are accomplished in a preferred embodiment of the present invention by providing a spent cartridge collector which is affixed to a firearm and utilizes as a part thereof a slightly modified M-16 rifle brass deflector as a mounting bracket. A sheet metal deflector assembly is affixed to the mounting bracket by a hinge permitting inspection of the ejection port of the firearm. The deflector assembly is shaped to have a large internal volume which extends forward of the ejection port of the firearm to minimize jamming of the firearm by a rebounding shell, but is raked or slanted towards the marksman on its forward end to permit left-handed marksmen to properly grasp the firearm. A collection bag or receptacle is affixed to the deflector assembly by thumbsnaps. The bottom of the bag is closed by Velcro strips which facilitate periodic emptying of the bag.

The foregoing and and other advantages, objects and features of the invention will become readily apparent to those skilled in the pertinent art from the following detailed description of the preferred embodiment of the invention and the related drawings.

Figure 1:
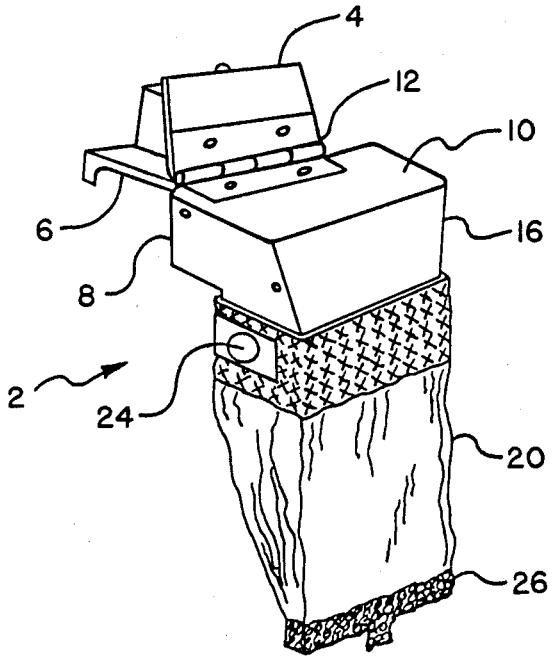
FIG. 1 is a perspective view of the spent cartridge collector of the present invention.

Referring now to the drawings, and in particular to FIG. 1 thereof, the preferred embodiment of the spent cartridge collector 2 includes a mounting bracket 4 adapted to be attached at surface 6 to a firearm (not shown) such that the inlet 8 to a deflector assembly 10 is in registration with the cartridge ejection port of the firearm. The firearm may be an M-16 rifle, and mounting bracket 4 is preferrably an M-16 Rifle Brass Deflector DVC-T 23-30 which has been slightly modified as described later herein to mate with deflector assembly 10. The M-16 Rifle Brass Deflector, as supplied to the government, is a palm-sized plastic device adapted to be mounted on the M-16 rifle and configured to deflect expended M-16 cartridges downward from the marksman. It includes a back plate which protects left-handed shooters from being struck by expended cartridges.

Deflector assembly 10 is affixed to mounting bracket 4 by means of a hinge 12 which permits the deflector assembly 10 to be raised in order to expose the ejection port of the firearm for inspection.

It will be seen from FIG. 1 (and several other figures) that hinge 12 is asymmetrically positioned on the top surface 14 of deflector assembly 10. Because of the rearward rake of the front end or surface 16 of the deflector assembly 10 to reduce the overall size of the deflector assembly, blank cartridges, which are larger than normal cartridges, might normally have a tendency to strike the forward surface and spring back into the ejection port of the firearm. By hinging the deflector assembly directly over the ejection port of the firearm and near its back surface 18, the deflector assembly 10 can be placed further forward on the firearm, permitting spent cartridges to fall harmlessly into a fabric receptacle or bag 20. The forward surface 16 of deflector assembly 10 can now be raked back so that it will result in a more compact device and will not obstruct the operation of the firearm by a left-handed shooter.

Spent cartridge collection bag 20 is affixed to the discharge opening of the deflector assembly 10 by thumb snaps 24, and has an opening at the bottom thereof for emptying the bag. The opening is closed by two matching strips 26 which tightly grip each other when they are brought into engagement. Such a material is marketed by the Textron Inc. Company of New York, N.Y., under the tradename Velcro. An alternate arrangement might utilize snaps or a zipper for closure of the bag.

Figure 2C:
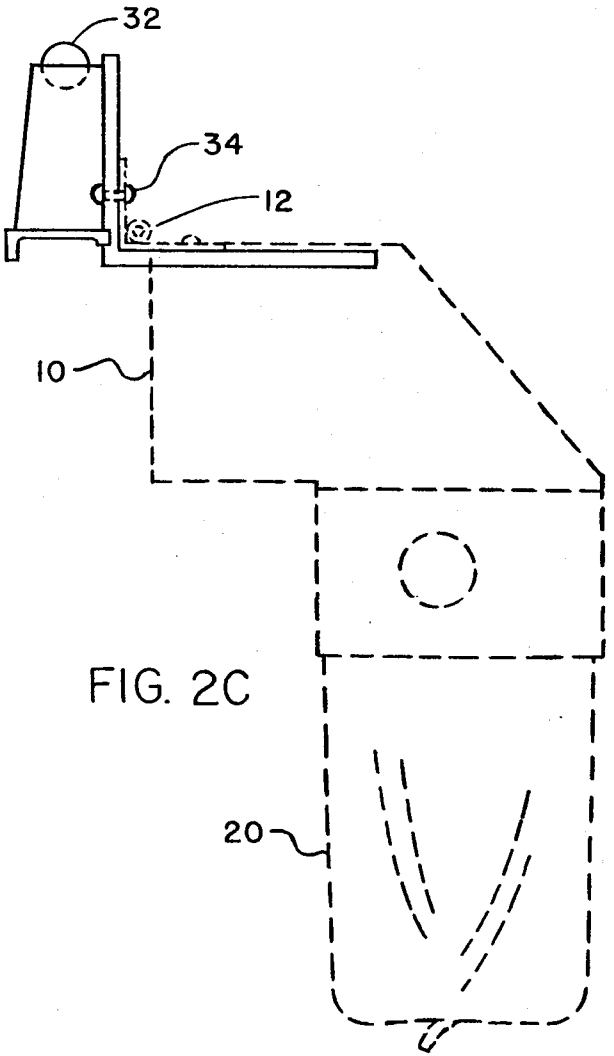
FIGS. 2A, 2B and 2C are side, top and rear views respectively of the cartridge mounting bracket of the present invention.
Figure 2A:
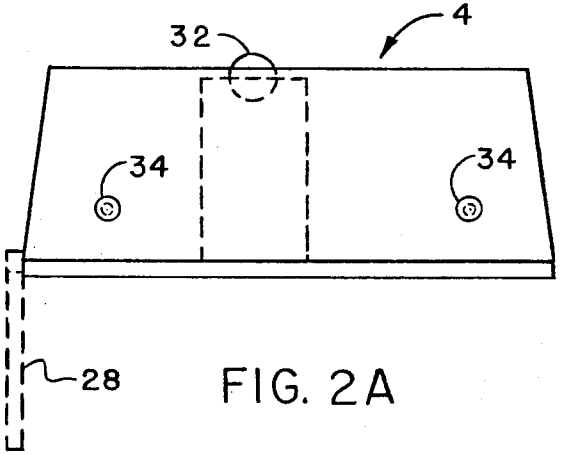
Figure 2B:
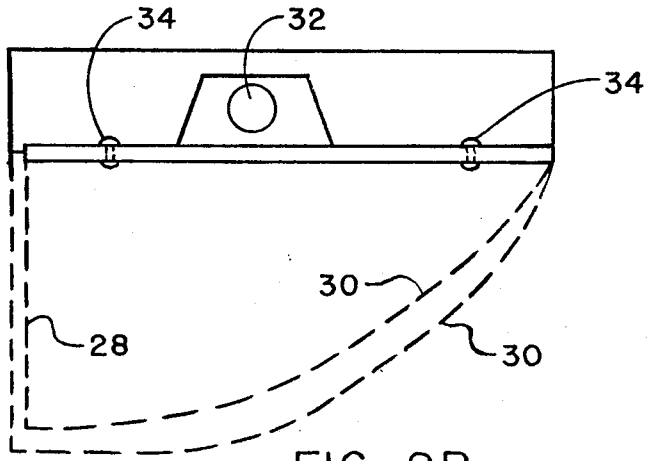

FIGS. 2A, 2B and 2C show the side, top and rear views of the mounting unit 4 of the present invention. The dashed lines 28 and 30 in FIGS. 2A and 2B respectively show the areas of the standard issue M-16 Rifle Brass Deflector which are cut away to accommodate the deflector assembly 10 of the present invention, while the attachment of the deflector assembly 10 and cartridge collection receptical 20 to the mounting unit 4 is shown by dashed lines in FIG. 2C.

Mounting unit 4 includes a spring-loaded ball-bearing 32 for securing the mounting unit 4 to the upper receiver assembly on an M-16 rifle. Rivets 34 attach hinge 12 of the deflector assembly 10 to the mounting bracket 4.

Figure 3C:
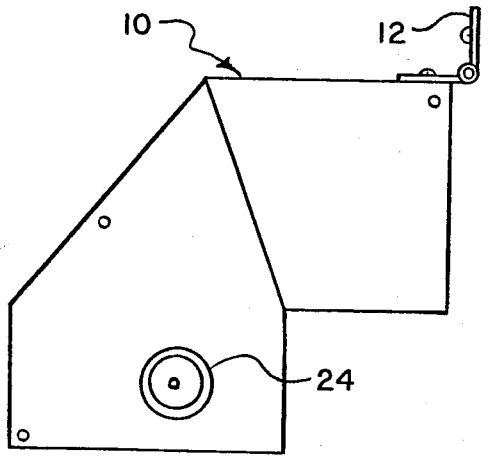
FIGS. 3A, 3B and 3C are top, side and front views respectively of the deflector assembly of the present invention.
Figure 3A:
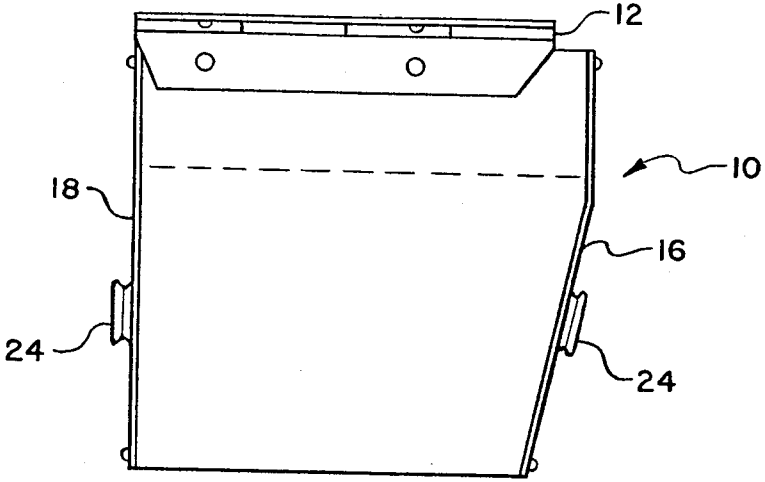
Figure 3B:
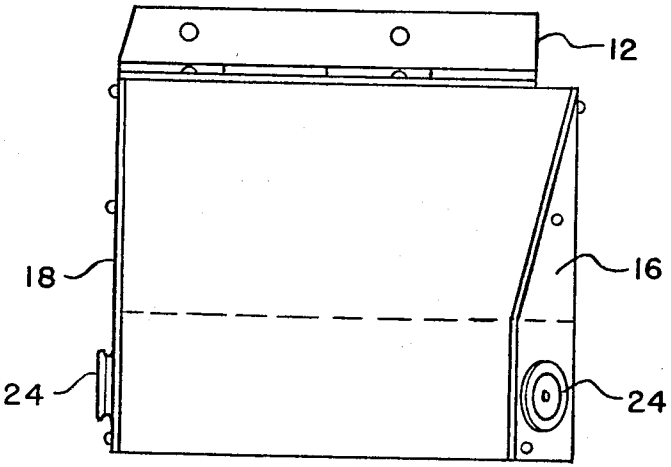

FIGS. 3A, 3B and 3C show the top, side and front views respectively of the aluminum deflector assembly 10, including the male portion of the thumb snaps 24, the slanted front surface 16, and the offset hinge 12.

Figure 4B:
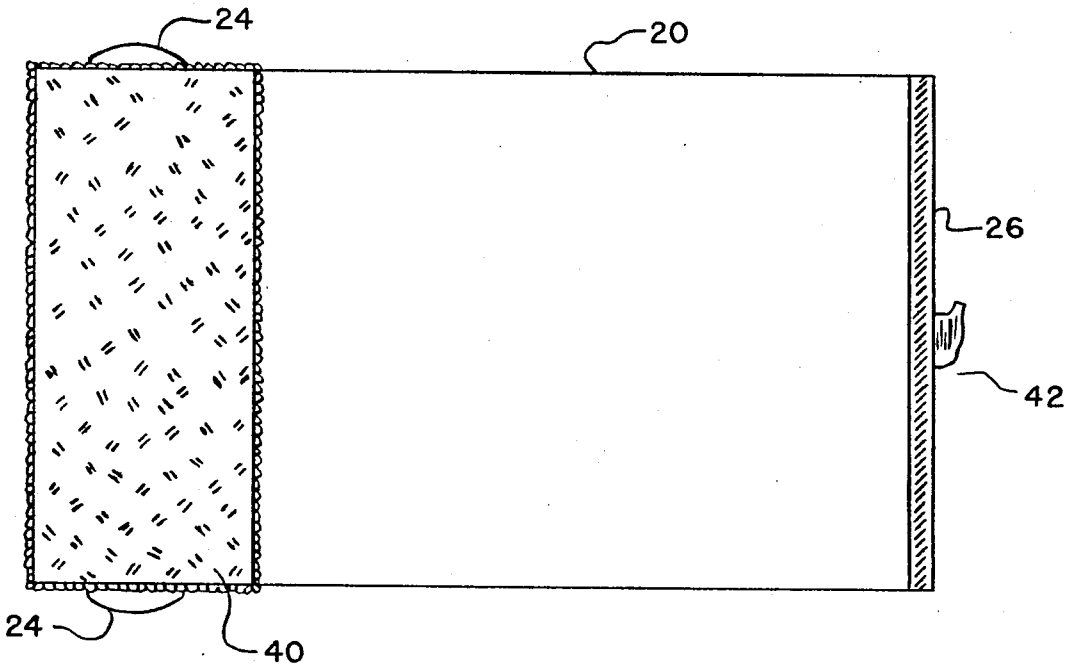
FIGS. 4A and 4B are top and side views respectively of the cartridge collection receptacle of the present invention.
Figure 4A:
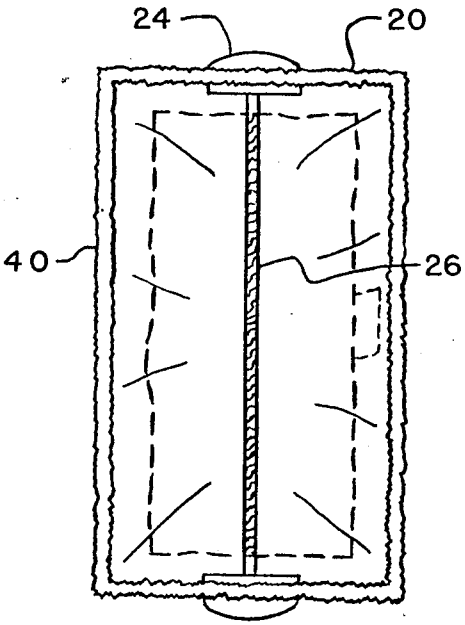

FIGS. 4A and 4B show the top and side views respectively of the cartridge collection bag 20, including thumbsnaps 24 which hold the bag to deflector assembly 10. Bag 20 is preferrably made of cloth material which may be reinforced at its top by a band of heavier material 40, such as braided cord material. Velcro strips 26 secure the bottom of bag 20. Tabs 42 have been sewn to the middle of the Velcro strips to facilitate opening of the bag 20 to empty its contents.

In operation cartridge casings ejected by a firearm are propelled into deflector assembly 10 where they strike the walls thereof and fall into pouch 20. Inspection of the ejection port of the firearm can be made without removing the spent cartridge collector from the firearm by merely lifting up the bag 20. The bag 20, when filled, can be emptied by opening Velcro strips 26 at the bottom thereof.

While the present invention has been described in connection with a rather specific embodiment thereof, it will be understood that many modifications and variations will be readily apparent to those of ordinary skill in the art and that this application is intended to cover any adaptation or variation thereof. Therefore, it is manifestly intended that this invention be only limited by the claims and the equivalents thereof.

What is claimed is:

1. A spent cartridge collector for receiving and collecting empty shell casings ejected through a cartridge ejection port in the wall of a firearm comprising:

a mounting unit for securing said spent cartridge collector to a firearm, a deflector assembly affixed to said mounting unit and having an inlet port enveloping said cartridge ejection port of said firearm, an outlet port, a top surface, a front surface and a rear surface, said inlet port being substantially larger than said cartridge ejection port and being asymmetrically positioned with respect to said mounting unit and said cartridge ejection port to extend beyond said ejection port in a direction towards the muzzle of said firearm and provide an internal volume in said deflector assembly forward of said ejection port, said deflector assembly being hinged to said mounting unit above said cartridge ejection port to permit inspection of said cartridge ejection port of said firearm, and having said outlet port substantially orthogonal to said inlet port, said deflector assembly being formed of sheet metal and having a planar part of said top surface inclined downwardly to redirect shell casings entering said inlet port towards said output port, said deflector assembly having a planar part of said front surface aligned substantially perpendicular to said cartridge ejection port and inclined rearwardly towards the butt end of said firearm to redirect shell casings impinging thereon towards said butt end of said firearm and permit operation of said firearm by left-handed marksmen with said cartridge collector mounted thereon, and a cartridge collection bag affixed to said outlet port of said deflector assembly, said bag having a pair of Velcro strips affixed to the bottom thereof for opening said bag to remove collected shell casings from said bag.

* * * * *